United States Patent [19]

Reese

[11] 3,955,734

[45] May 11, 1976

[54] TOW STRAP ASSEMBLY

[75] Inventor: Dean C. Reese, Huntsville, Ala.

[73] Assignee: The United States of America as represented by the Secretary of the Army, Washington, D.C.

[22] Filed: Jan. 2, 1975

[21] Appl. No.: 538,299

[52] U.S. Cl. ..... 224/58; 224/55; 224/5 P; 24/265 AL

[51] Int. Cl.[2] ..... B65D 71/00

[58] Field of Search ..... 224/55, 58, 57, 46, 224/45 S, 1 A, 11, 12, 5 P, 22; 24/243 SC, 248 B, 265 AL

[56] References Cited

UNITED STATES PATENTS

| | | | |
|---|---|---|---|
| 119,293 | 9/1871 | Alexandre | 224/5 R |
| 1,663,708 | 3/1928 | Keeler | 224/55 |
| 1,847,501 | 3/1932 | Stahler | 224/58 |
| 2,446,197 | 8/1948 | Sloan | 224/1 A |
| 3,187,967 | 6/1965 | Sample | 224/5 P |

FOREIGN PATENTS OR APPLICATIONS

| | | | |
|---|---|---|---|
| 428,409 | 5/1935 | United Kingdom | 224/5 P |

*Primary Examiner*—Robert J. Spar
*Assistant Examiner*—Kenneth Noland
*Attorney, Agent, or Firm*—Nathan Edelberg; Robert P. Gibson; William P. Murphy

[57] ABSTRACT

A carrier with a connector secured between terminals for enclosing spaced portions of an object for support thereof, a link disposed for removable engagement with intermediate points of the connector to form a loop therein and limit the support portions of the connector, means for securing the loop to the link and to the support portions.

3 Claims, 3 Drawing Figures

TOW STRAP ASSEMBLY

BACKGROUND OF THE INVENTION

The carrier is made primarily for transportation of ungainly objects by personnel and may include a removable shoulder pad to distribute the support.

SUMMARY OF THE INVENTION

A carrier includes a connector secured between terminals for adjustably enclosing spaced portions of an object for support thereof, a link with clamps for removable wedged engagement with intermediate points of the connector to form a loop therein and limit the support portions of the connector, a fastener to removably secure the center of the connector to the link, rings to secure the loop to the support portions, and a pad for removable attachment to the connector to distribute support of the object.

DESCRIPTION OF THE PREFERRED EMBODIMENT

Figure 3:
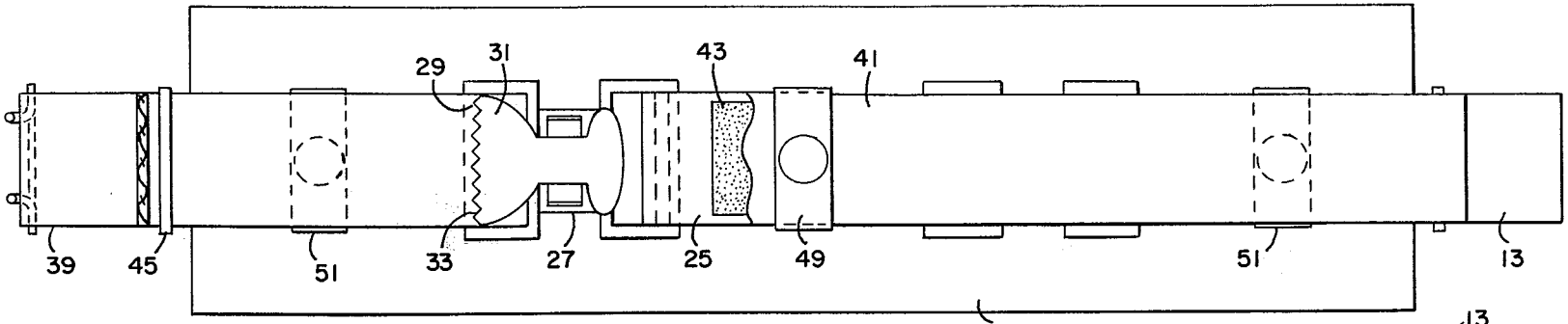
FIG. 3 is a top view of carrier 11.
Figure 4:
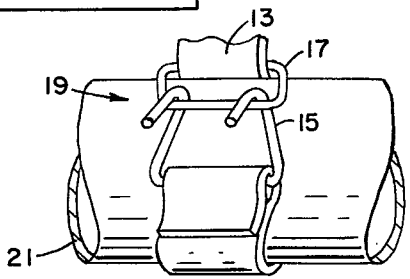
FIG. 4 is a detail view of terminals 19 engaging object 21.
Figure 1:
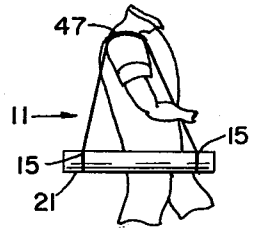
FIG. 1 shows carrier 11 in position for transport of an object 21.
Figure 2:
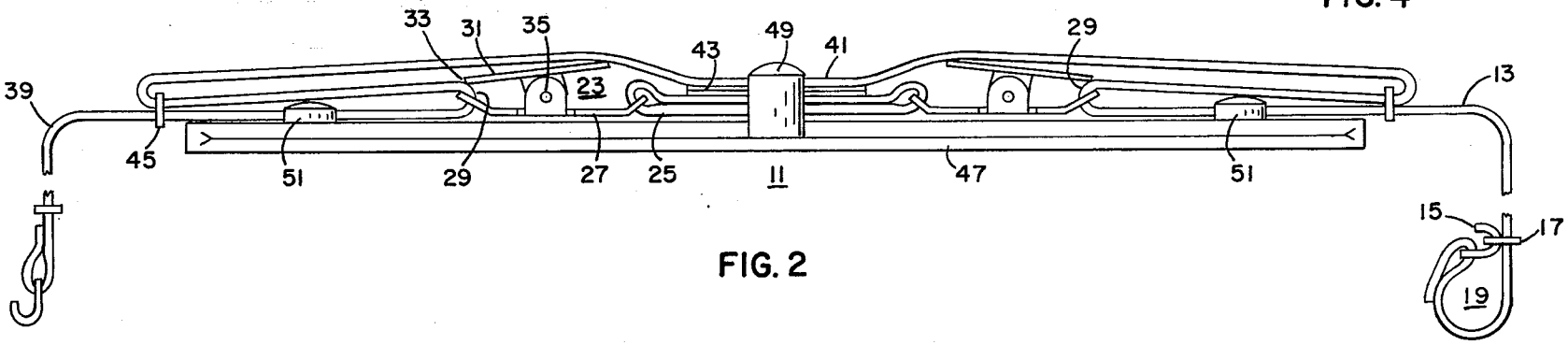
FIG. 2 is an elevation view of carrier 11.

A carrier 11 includes a connector 13 secured between hooks 15. Bands 17 adjacent thereto enclose connector 13 for respective engagement with hooks 15 to provide terminals 19 for adjustably enclosing spaced portions of an object 21. A link 23 includes a member 25 secured between clamps 27 enclosing connector 13 at intermediate points 29 thereof. Clamps 27 respectively include keepers 31 provided with serrated edges

33 and pivoted at 35. Clamps 37 are respectively provided with bars 37 and keepers 31 are spring-biased for releasable wedged relation of connector 13 with bars 37 to limit the portions 39 of connector 13 supporting object 21 and provide a loop 41 in connector 13.

A fastener 43 is disposed to connect the center of connector 13 to member 25 and a pair of rings 45 respectively secure loop 41 to portions 39. A pad 47 is removably secured as at 49 and 51 to connector 13 for distribution of the support of object 21.

I claim:

1. A carrier for support of an object comprising:

a connector secured between terminals for engagement with spaced portions of the object for the support and said terminals provided with bands enclosing said connector and with hooks secured to the ends thereof for engagement with said bands to enclose the spaced portions of the object, a link disposed for removable connection between intermediate portions of said connector to form a loop therein and limit the portions thereof providing the support, and with said link provided with a pair of clamps disposed for respective removable engagement with said connector at the intermediate points, a bar and a keeper disposed on each of said clamps with said keeper provided with a serrated edge and pivoted for releasable spring-biased engagement thereof to wedge said connector against said bar, said link also having a member secured between said clamps; and a fastener disposed to removably secure the center of said connector to said member.

2. A carrier as in claim 1 with a pair of rings respectively disposed to secure said loop to said support portions.

3. A carrier as in claim 2 with a pad disposed for removable engagement with said connector for distribution of the weight of the object.

* * * * *